United States Patent [19]

Marraccini

[11] 3,945,596

[45] Mar. 23, 1976

[54] SUPPORT FOR FIXING OBJECTS REMOVABLY

[75] Inventor: Franco Marraccini, Marina di Massa (Massa), Italy

[73] Assignee: Ing. C. Olivetti & Co., S.p.A., Turin, Italy

[22] Filed: Apr. 16, 1974

[21] Appl. No.: 461,277

[30] Foreign Application Priority Data

Apr. 26, 1973 Italy ..... 68162/73

[52] U.S. Cl. ..... 248/311 R; 248/246

[51] Int. Cl.[2] ..... A24F 19/00

[58] Field of Search ..... 248/246, 221, 125, 311, 248/301, 211, 210, 307, 360; 131/231; 232/43.5; D85/2 H

[56] References Cited

UNITED STATES PATENTS

| | | | |
|---|---|---|---|
| 1,597,095 | 8/1926 | Martinsen | 248/246 |
| 1,738,557 | 12/1929 | Beiling | 131/231 X |
| 2,086,280 | 7/1937 | Matter | 248/246 |
| 3,156,443 | 11/1964 | Lupinacci | 248/211 |
| 3,370,820 | 2/1968 | Liss et al. | D85/2 H X |
| 3,740,012 | 6/1973 | Millen | 248/246 X |

FOREIGN PATENTS OR APPLICATIONS

| | | | |
|---|---|---|---|
| 613,564 | 12/1960 | Italy | 248/246 |
| 212,073 | 3/1924 | United Kingdom | 248/246 |
| 381,385 | 10/1964 | Switzerland | 248/246 |

*Primary Examiner*—Roy D. Frazier
*Assistant Examiner*—Robert W. Gibson, Jr.
*Attorney, Agent, or Firm*—Schuyler, Birch, Swindler, McKie & Beckett

[57] ABSTRACT

A support for fixing an object, for example an ashtray, palette, container or pen holder, removably in projecting manner to a substantially vertical structural member of office furniture, such as a leg of a chair or writing desk. The support comprises a wall of the object, following in complementary form substantially the shape of one side of a structural member having a predetermined cross-section, and a projection of the object opposite the wall. The wall and the projection bear against the structural member when in the operative position and are spaced from one another in such manner that the support may be removed by tilting it upwardly with respect to the structural member.

5 Claims, 6 Drawing Figures

SUPPORT FOR FIXING OBJECTS REMOVABLY

BACKGROUND OF THE INVENTION

The present invention relates to a support for fixing objects, for example ashtrays, palettes, containers and pen holders, removably in projecting manner to substantially vertical structural members of office furniture, such as the legs of chairs and writing desks.

In a known support of the above type, an arm integral with the object has a fixed lug and an opposite lug which can be swivelled and is adapted to be fixed to the structural member by means of a setscrew. This may entail the use of a tool and a considerable loss of time. This and other disadvantages are obviated by the support according to the invention.

SUMMARY OF THE INVENTION

The present invention provides a support for fixing an object, for example an ashtray, palette, container or pen holder, removably in projecting manner to a substantially vertical structural member of office furniture, such as a leg of a chair or writing desk. The support comprises a wall of the object, following in complementary form substantially the shape of one side of a structural member having a predetermined cross-section, and a projection opposite the wall, the wall and the projection bearing against the structural member when in the operative position and being spaced from one another in such manner that the support may be removed by tilting it upwardly with respect to the structural member.

In this way, when the support is fitted, the wall and projection retain the object on the structural member in a predetermined position through their grip, and removal of the object can be achieved by means of a simple upward tilting action and a following transverse movement of the object with respect to the structural member.

The invention will be described in more detail by way of example, with reference to the accompanying drawing.

DETAILED DESCRIPTION OF THE INVENTION

In this example, the support according to the invention is applied to an ashtray fixable removably to the leg of a chair and the cross-section of the leg is substantially U-shaped.

Figure 1:
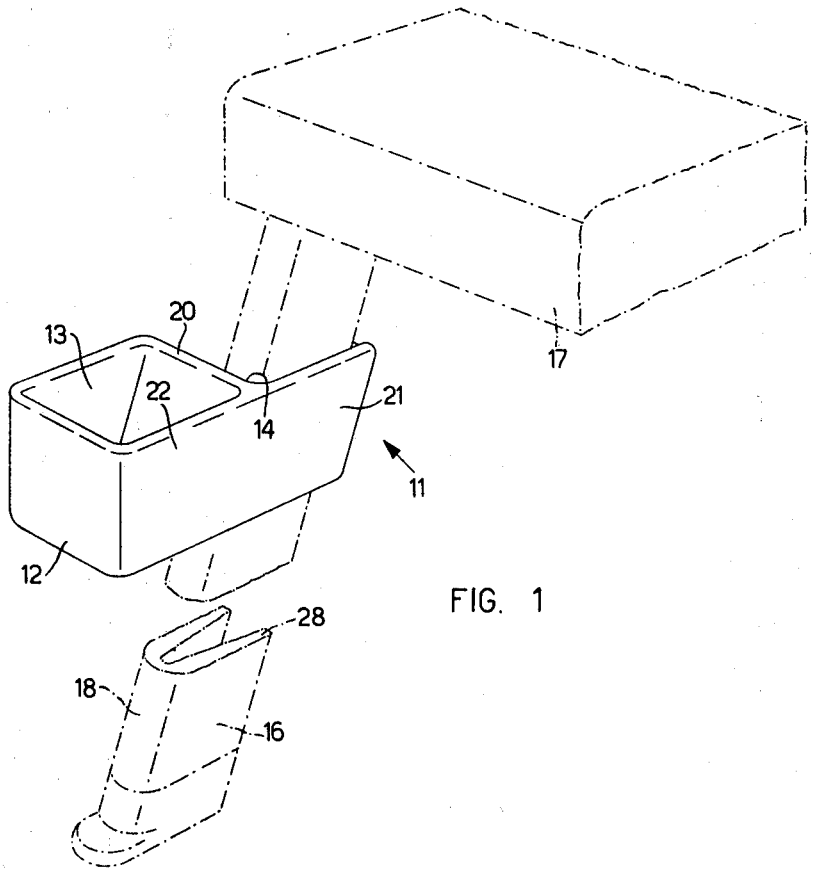
FIG. 1 is a front perspective view from the right of a support according to the invention applied to an ashtray fixed removably to the leg of a chair.
Figure 2:
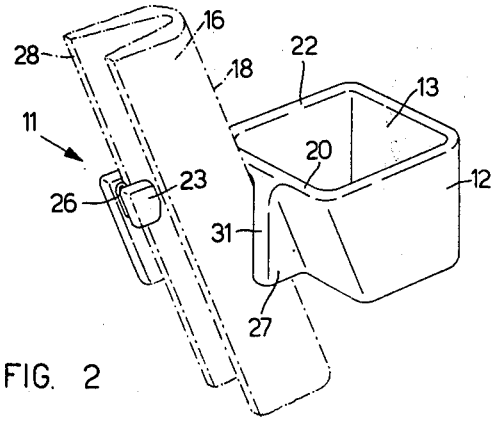
FIG. 2 is a rear perspective view of the support of FIG. 1 from the left.

Referring to FIG. 1, the support is indicated generally by the reference 11 and is integral with an ashtray 12 of substantially prismal form which is open at the top and hollow internally so as to define a receptacle 13.

The support 11 comprises a first wall 14 (FIG. 4) formed on one side of the ashtray 12 and following or repeating in complementary form substantially the shape of a part of the U-shaped structural member 16 constituting the leg of a chair 17 (FIG. 1). In this particular case, the wall 14 (FIG. 4) is of substantially circularly cylindrical form and copies a circularly cylindrical outer profile 18 connecting the arms or sides of the leg 16. The support 11 moreover comprises a projection 19 (FIG. 3) opposite and substantially parallel to the first wall 14. The wall 14 and projection 19 are spaced from one another in such manner that, by tilting the support 11 (FIG. 5) upwardly with respect to the leg 16 about the projection 19, they permit the support 11 itself to be engaged with and removed from the leg 16. The first wall 15 (FIG. 3) is formed on one side 20 of the ashtray which forms an obtuse angle within the ashtray with respect to the bottom thereof, so that the bottom remains horizontal when the ashtray is supported by an inclined leg. The projection 19 is formed on a second wall 21, which is an extension of a side 22 (FIG. 4) of the ashtray 12. The first wall 14 and projection 19 are thus disposed at one end of the ashtray 12 so that the centre of gravity of the ashtray is completely outside the support 11. The projection 19 terminates in a lug 23 (FIG. 6) shaped to define a recess 24. In addition, the projection 19 carries a resilient ring 26 (FIG. 3) having a high coefficient of friction, such as a rubber ring.

Figure 3:
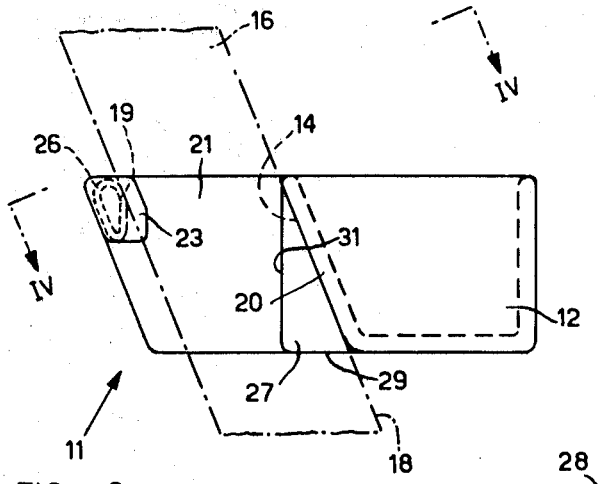
FIG. 3 is a side view of the support of FIG. 1.

Finally, at one side of the first wall 14, the support 11 includes an essentially triangular extension 27 (FIG. 3). One horizontal edge 29 of the extension 27 projects in line with the bottom of the ashtray and another vertical edge 31 of the extension 27 joins up with the top edge of the ashtray so that the extension 27 is shaped like a nose. The extension 27 cooperates with the leg 16 to prevent rotary movement of the support 11 about the axis of the leg when the ashtray 12 is mounted thereon.

To fit the support 11 to the leg 16 the following procedure is followed.

Figure 4:
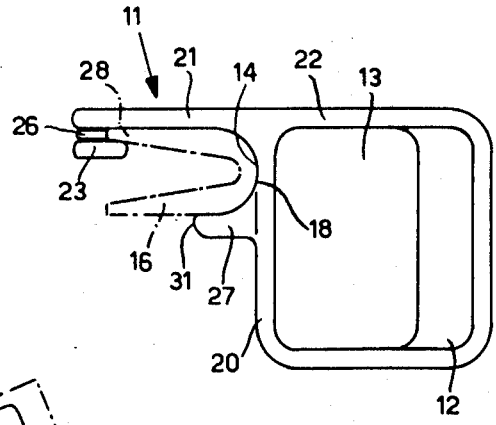
FIG. 4 is a view of the device as shown in FIG. 3 in the direction IV indicated therein.
Figure 5:
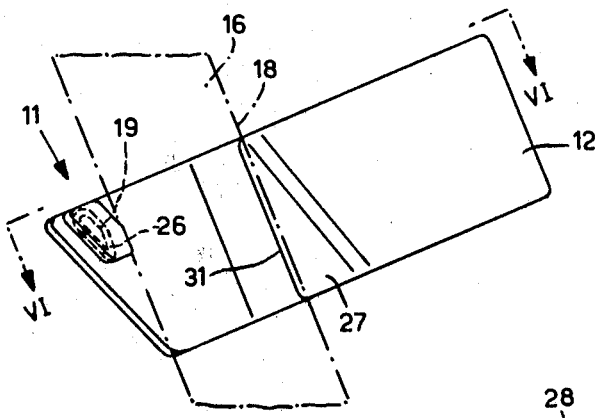
FIG. 5 is a side view of the support of FIG. 1 in a fitting position.
Figure 6:
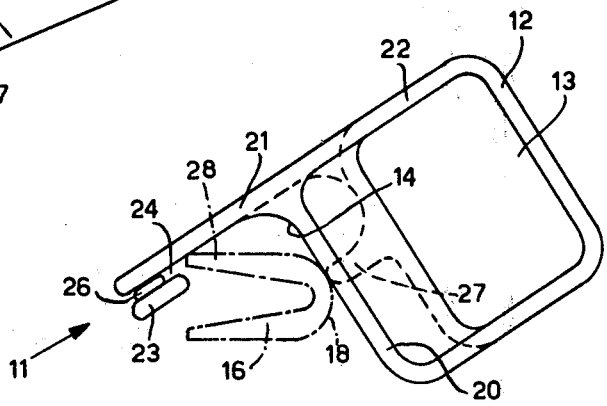
FIG. 6 is a view of the device as shown in FIG. 5 in the direction VI indicated therein.

The ashtray 12 is grasped with one hand and is arranged so that the edge 31 of the extension 27 is parallel to the profile 18 and the edge 28 of the leg 16 is in contact with the second wall 21, as shown in FIGS. 5 and 6. The ashtray 12 (FIG. 6) is now turned clockwise about a vertical axis until the second wall 21 is brought into contact with the side of the leg 16 and the recess 24 is brought into engagement with the edge 28. The ashtray 12 is tilted downwardly about the projection 19 until the wall 14 is in parallel contact with the profile 18 and the extension 27 lies parallel and adjacent to the leg 16, thus preventing rotation of the ashtray, as shown in FIG. 4. The ring 26, pressing against the edge 28 of the leg improves the grip between the projection 19 and the edge 28. As an alternative to the ring 26, an element of resilient material having a high coefficient of friction may be attached to the wall 14, where it improves the grip between the wall 14 and the profile 18 of the leg 16. In either case, the tendency for the support to slide down the leg is countered.

The perpendicular distance between the wall 14 and the nearer side of the ring 26 is slightly less than the width of the leg 16, which in this case is the distance measured normally between the profile 18 and the edge 28. A stress is therefore created due to the slight difference in dimensions, which causes slight squeezing of the ring and assists in increasing the grip of the support 11 on the leg 16.

To remove the ashtray 12 from the leg 16, it is grasped with one hand and is tilted upwardly about the projection 19 so that the wall 14 ceases to make parallel contact with the profile 18, and the extension 27 is disposed with the edge 31 parallel to the profile 18, as shown in FIG. 5. Since the circularly cylindrical wall 14 and the extension 27 have lost close contact with the leg 16, the ashtray itself may be turned anticlockwise about a vertical axis. The recess 24 leaves the edge 28 as the ashtray may be removed from the leg 16.

It is understood that diverse modifications, variations and improvements may be made in the described support 11 without departing from the scope of the claims. For example, if the cross-section of the leg 16 is circular, the second wall 21, the first wall 14 and part of the projection 19 have to be circularly cylindrical and have a radius of curvature equal to that of the outer surface of the leg 16. If, on the other hand, the cross-section of the leg 16 is rectangular, the wall 14 will no longer be circularly cylindrical, but will be constituted by a plane surface with parts at two opposite edges corresponding to the parts 21 and 27 of the described embodiment, while the projection 19 will also be planar.

It is therefore clear that the support 11 is formed essentially by a wall 14 forming part of the ashtray 12 which follows or repeats in complementary form the outer shape 18 of the leg 16. The support 11 moreover comprises a projection 19 opposite the wall 14. When the wall 14 and projection 19 are in the supporting position, they bear against the leg 16 and are spaced from one another in such manner that by tilting the support 11 upwardly with respect to the leg 16 about the projection 19, the support may be removed.

What I claim is:

1. An ashtray, removably mountable in projecting manner to a substantially vertical structural member, said member having a substantially U-shaped cross-section including two arms and a circular profile connecting said arms, each of said arms being defined by an outer wall adjacent to the outer circular profile, an inner wall and an edge wall connecting the inner wall with the outer wall, said ashtray including a substantially parallelepipedal hollow body having at one side thereof a substantially circular cylindrical portion for cooperating with and complementary to said circular profile of said structural member and two extensions of said body, arranged at two sides of said cylindrical portion, for cooperating with the outer walls of said arms, one of said two extensions having an end wall inclined with respect to said one side of said hollow body ashtray, said one extension overlying partially a portion of one outer wall of an arm of said two arms, the other of said extensions being parallel with said one extension and overlying the entire depth of the outer wall of the other arm of said arms, said other extension having in an upper portion and near to the distal end thereof extending beyond the depth of said outer wall a projection opposite said cylindrical portion for cooperating with the edge wall of the other of said two arms, said projection being provided with a lug cooperative with the inner wall of said other arm adjacent said edge, said cylindrical portion and said projection bearing against said leg when in the mounted position, so that the centre of gravity of the ashtray is completely outside said structural member, said cylindrical portion, said projection and said lug defining a recess for holding said edge wall and being spaced from one to another in such manner that the ashtray may be removed by tilting it upwardly so as to disengage the lower portion of said one extension from said one arm so that the inclined end wall thereof may pass by the structural member and thereafter rotating the ashtray with respect to the structural member so as to disengage the lug of the projection from the inner wall of said other arm of the structural member and remove said edge wall from said recess.

2. An ashtray according to claim 1, further comprising a rubber ring with a high coefficient of friction carried by said projection for increasing the grip of the projection on the edge wall of the structural member.

3. An ashtray according to claim 2, wherein the other of said extensions is aligned with another side of said ashtray body adjacent said one side.

4. An ashtray according to claim 3, wherein said one side of said ashtray forms an obtuse angle within the ashtray with respect to the bottom wall thereof, so that the ashtray bottom remains horizontal when the ashtray is supported by the structural member.

5. An ashtray as claimed in claim 4, wherein said lug comprises a cut-off portion substantially parallel to the inclination of said end wall of said one extension, so that said lug rotates past said edge wall when said ashtray is rotated upwardly as said one extension is rotated past said structural member.

* * * * *